United States Patent [19]

Wilson

[11] 4,032,047

[45] June 28, 1977

[54] LIQUID DISPENSING CONTAINER CONSTRUCTION

[75] Inventor: Calvin L. Wilson, Richmond, Va.

[73] Assignee: Reynolds Metals Company, Richmond, Va.

[22] Filed: May 5, 1976

[21] Appl. No.: 683,411

Related U.S. Application Data

[63] Continuation of Ser. No. 550,979, Feb. 19, 1975, abandoned.

[52] U.S. Cl. ..... 222/183; 220/5 R; 220/DIG. 1; 248/146

[51] Int. Cl.² ..... B67D 5/64

[58] Field of Search ..... 222/130–131, 222/183, 399, 400.7; 220/DIG. 1, 257, 5 R; 248/152–153, 128, 146

[56] References Cited

UNITED STATES PATENTS

| | | | |
|---|---|---|---|
| 835,408 | 11/1906 | DeVore et al. | 222/399 X |
| 2,760,671 | 8/1956 | Parish, Jr. | 220/257 X |
| 2,840,629 | 6/1958 | Roth et al. | 248/152 X |
| 3,243,085 | 3/1966 | Wilson | 222/399 X |
| 3,568,890 | 3/1971 | Leachman | 222/183 |
| 3,762,431 | 10/1973 | Wilson et al. | 222/399 |
| 3,840,141 | 10/1974 | Allom et al. | 220/5 R |
| 3,843,027 | 10/1974 | Wilson et al. | 222/400.7 |

FOREIGN PATENTS OR APPLICATIONS

| | | | |
|---|---|---|---|
| 1,134,911 | 8/1962 | Germany | 222/399 |
| 287,552 | 6/1928 | United Kingdom | 220/DIG. 1 |

*Primary Examiner*—Drayton E. Hoffman
*Assistant Examiner*—Charles A. Marmor
*Attorney, Agent, or Firm*—Glenn, Lyne, Gibbs & Clark

[57] ABSTRACT

A liquid dispensing container construction particularly adapted to dispense a liquid, such as a carbonated beverage for example, under gaseous pressure is provided and comprises a housing defining a product chamber for the liquid with the housing comprising a cylindrical central portion and a pair of outwardly convex end portions. A spigot device is carried by one of the end portions for dispensing the liquid from within the chamber, and a closeable filler device for the chamber is provided in the other of the end portions. The container construction has a protective sleeve for the housing and the devices with the sleeve having opposed end edges each adapted to support the container construction.

17 Claims, 11 Drawing Figures

LIQUID DISPENSING CONTAINER CONSTRUCTION

This application is a continuation of Ser. No. 550,979 filed Feb. 19, 1975 now abandoned.

BACKGROUND OF THE INVENTION

Reusable liquid dispensing containers for carbonated beverages such as soft drinks, beer, and the like, have been proposed and sold heretofore for home use. It has been found that is is preferable to provide such a liquid dispensing container of a size that will enable such container to be stored and used while in the common household refrigerator and such a container is provided with a charging propellent, such as carbon dioxide, supplied thereto from a separate external source which may be readily attached to and detached from the dispensing container whereby the beverage in a large number of dispensing containers may be dispensed using a single source or container of charging propellent.

However, a problem with previously proposed beverage dispensing containers of the character mentioned is that they have a single opening therein which receives a dispensing spigot device and such opening is also used in cleaning the container and is used by a beverage bottler for filling purposes. Such opening is usually of a special non-standard size because it must receive the beverage dispensing spigot device whereby a bottlers costs are increased substantially when it is not possible to utilize standard bottling equipment to clean and fill these containers. An added problem with containers of this type is that the bottler in many instances also receives the beverage dispensing spigot device assembly or spigot device with the empty dispensing container requiring special handling thereof and requiring that such spigot assembly also be sanitized by the bottler. These problems have resulted in many bottlers resisting the bottling of their carbonated beverages in previously proposed beverage dispensing containers of the character mentioned.

SUMMARY

This invention provides a reusable dispensing container construction particularly adapted to dispense a liquid such as a carbonated beverage, for example, under carbon dioxide gas pressure and which overcomes the above-mentioned problems. The container construction of this invention comprises a housing defining a product chamber for the liquid with the housing comprising a cylindrical central portion and a pair of outwardly convex end portions. A spigot device is carried by one of the end portions for dispensing the liquid from within the chamber, and a closeable filler device for the chamber is provided in the other one of the end portions. The closeable filler device is sized so that it corresponds to associated fittings on commerically available cleaning and filling equipment used by beverage bottlers, and the container construction has a protective sleeve for the housing and the devices with the sleeve having opposed end edges each adapted to support the container construction essentially in an upright manner.

Other details, uses, and advantages of this invention will become apparent as the following description of the exemplary embodiments thereof presented in the accompanying drawings proceeds.

BRIEF DESCRIPTION OF THE DRAWINGS

The accompanying drawings show present preferred embodiments of this invention, in which.

DETAILED DESCRIPTION

Figure 1:
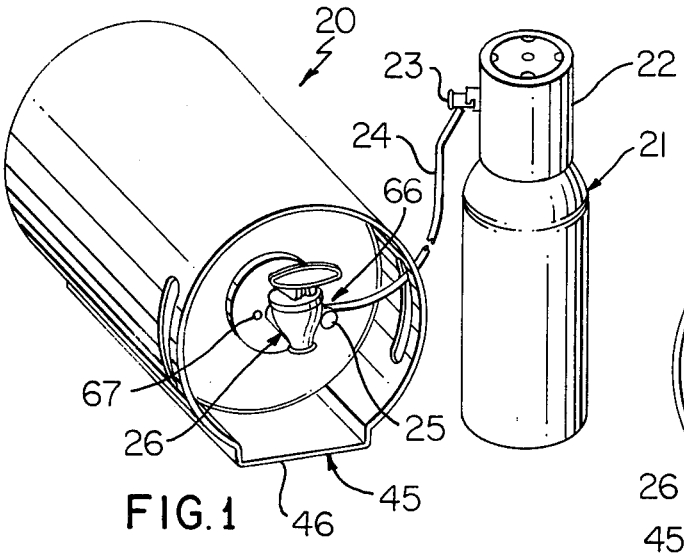
FIG. 1 is a perspective view of one exemplary embodiment of a beverage dispensing container of this invention and an associated propellant source bottle.

Reference is now made to FIGS. 1–5 of the drawings which illustrate one exemplary embodiment of a liquid dispensing container construction of this invention which is particularly adapted to dispense a liquid, such as a carbonated beverage, under gaseous pressure and such container construction is designated generally by the reference numeral 20. The container construction 20 is particularly adapted to dispense a carbonated beverage B from within the container construction 20 utilizing carbon dioxide which is provided from a source thereof in the form of a high pressure bottle 21 of known construction and the source or bottle 21 has a pressure regulator construction or regulator 22 which serves to control and supply carbon dioxide under regulated pressure through a detachable fitting 23 attached to regulator 22, a flexible tube or conduit 24, and another detachable fitting 25 attached to spigot device 26 which is detachably fastened to the dispensing container construction or container 20 in a manner to be described in detail subsequently. The construction of bottle 21, pressure regulator 22, fittings 23 and 25 together with conduit 24, and the manner in which these components operate to provide carbon dioxide under regulated pressure to the beverage B contained within the dispensing container 20 are well known as will be seen in U.S. Pat. No. 3,762,431 dated Oct. 2, 1973, for example, which discloses similar components for the same purpose.

Figure 5:
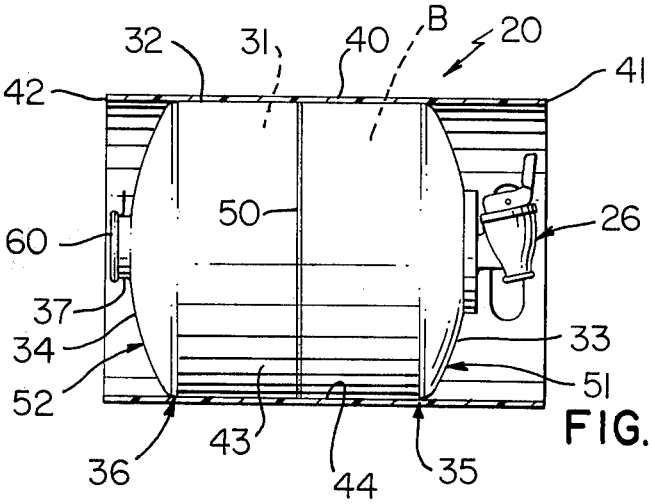
FIG. 5 is a side view of the beverage dispensing container of FIG. 1 with an outer tubular protective sleeve thereof bisected on a vertical plane through a central longitudinal axis of the container.
Figure 6:
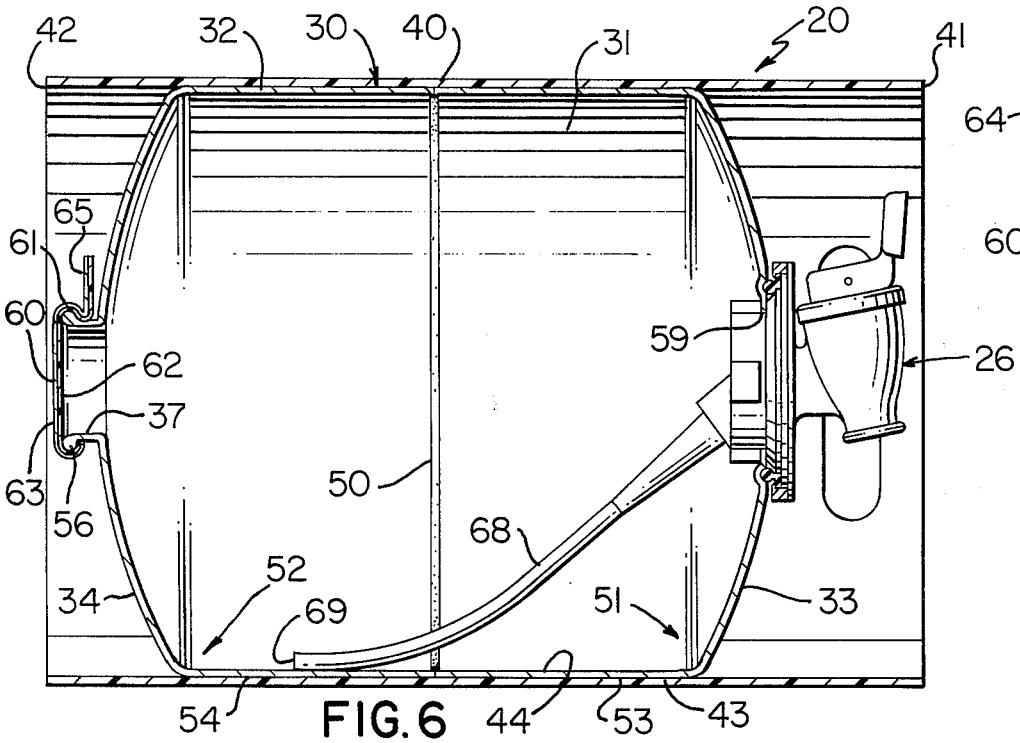
FIG. 6 is an enlarged cross-sectional view similar to FIG. 5 also showing the housing defining the product chamber in cross-section and showing the spigot device in elevation.

As best seen in FIGS. 5 and 6, the container construction 20 comprises a housing 30 defining a product chamber 31 for containing the liquid carbonated beverage B which is charged with carbon dioxide from the bottle 31 in the manner previously mentioned. The housing 30 comprises a right circular cylindrical central portion 32 and a pair of outwardly convex end portions 33 and 34 provided at opposite ends, indicated at 35 and 36 respectively, of the cylindrical portion 32. The previously mentioned spigot device 26 is carried by one of the end portions shown as the end portion 33 and a closeable filler device designated generally by the reference numeral 37 is provided by the other outwardly convex end portion 34.

The container construction 20 has a protective sleeve 40 for the housing 30 defined by portions 32, 33, and 34 and the devices 26 and 37, and the sleeve 40 has opposed end edges 41 and 42 each of which is arranged substantially in a single plane and each edge 41 and 42 is particularly adapted to support the container construction 20 in an upright manner with the sleeve 40 performing its protective function. The sleeve 40 enable a plurality of container constructions 20 to be readily stacked on end for transportation, storage, and similar purposes whereby the container constructions 20 may be easily handled and processed by a bottler, distributor, and retail establishment as well as an ultimate consumer.

The housing 30 is preferably made of a metallic material in the form of a lightweight aluminous material, for example, and the protective sleeve 40 is preferably made of a non-metallic material such as a comparatively hard plastic material. The sleeve 40 and housing are held together by a friction fit therebetween and such friction fit is provided by a comparatively tight tolerance between the outside surface 43 of the cylindrical portion 32 of the housing 30 and the inside surface 44 of the hard plastic protective sleeve 40.

Figure 2:
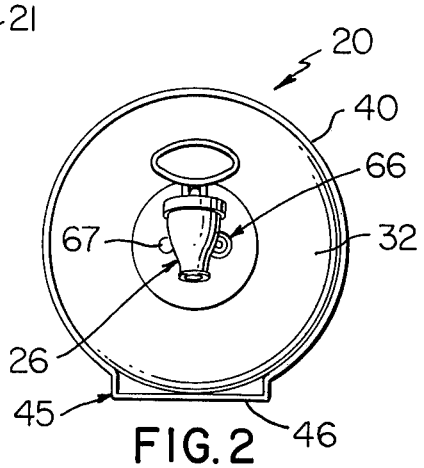
FIG. 2 is a front view of the beverage dispensing container of FIG. 1.
Figure 3:
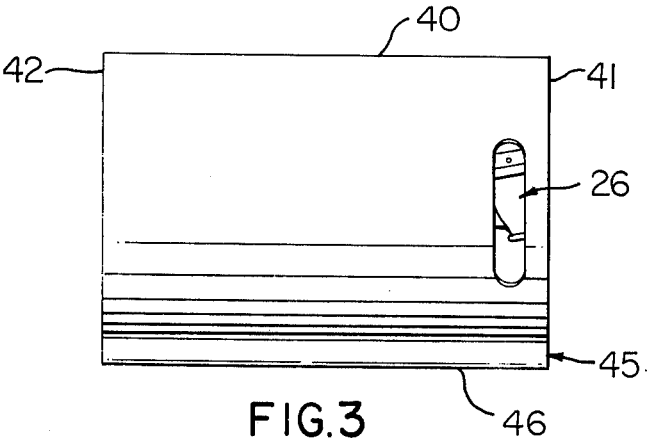
FIG. 3 is a side view of the beverage dispensing container of FIG. 1.
Figure 4:
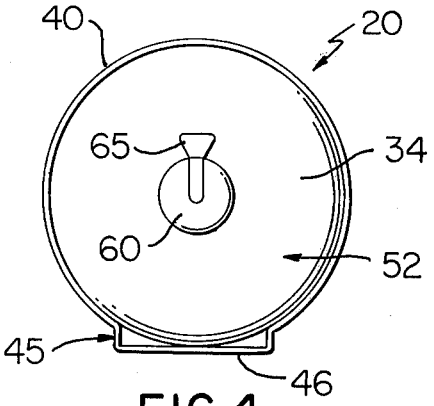
FIG. 4 is a rear view of the beverage dispensing container of FIG. 1.

As best seen in FIGS. 1–3 the protective sleeve 40 of the container construction 20 has anti-roll means designated, generally by the reference numeral 45, provided as an integral part thereof. The anti-roll means 45 in the form of what may be considered an integral bottom trough also designated 45 which extends the full length of sleeve 40. The trough or anti-roll means 45 has a substantially planar bottom supporting surface 46 and such trough also serves to collect any beverage which might drip from the spigot device 26 in the course of using the container construction 20 whereupon such collected beverage may be readily cleaned with a cloth, sponge, or the like.

The housing 30 is preferably made of an aluminous material as mentioned earlier; and, in the example of FIGS. 5 and 6 such housing is preferably a two piece housing comprised of two pieces joined together by a circumferential weld 50 and the two pieces are designated generally by the reference numerals 51 and 52 respectively. The piece or portion 51 is defined by approximately one half of the cylindrical portion 32, designated by the reference numeral 53, adjoined at its forward end by the outwardly convex end portion 33 and the piece or portion 52 is defined by approximately the other half of cylindrical portion 32, designated by the reference numeral 54, adjoined at its rearward end by the outwardly convex end portion 34.

The closeable filler device 37 for the chamber 31 is provided, in essence, as a tubular extension and is also defined as an integral part of the single piece 52 and in particular as an integral part of the outwardly convex portion 34 of piece 52. The portion or single piece 51 is comprised of portion 53 and its adjoining outwardly convex end portion 33.

Figure 8:
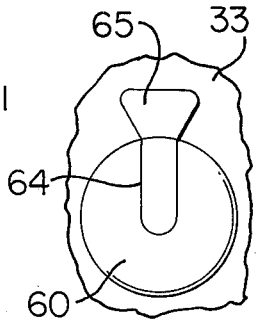
FIG. 8 is a fragmentary view looking toward the filler device of the container of FIG. 6.

The closeable filler device or integral fitting 37 of the container construction 20 has an outer annular bead 56 as shown in FIG. 6 and the bead 56 is particularly adapted to receive a closure in a form of a severable closure 60, also see FIG. 8. The closure 60 is mechanically crimped around the fitting 37 and in particular around the bead portion 56 thereof as illustrated at 61 to provide a seal for the chamber 31 and in particular for the beverage B contained in such chamber.

The severable closure 60 may be of any suitable type and in this example is shown as laminated construction comprised of a non-metallic or plastic inner portion 62 and a metallic outer portion 63 which has weakening means 64 provided as an integral part thereof. The closure 60 has a pull tab 65 which is adapted to be grasped and pulled to sever the closure along the weakening means 64 and thereby split such closure and enable it to be spread apart and pulled away from fitting 37. The fitting 37 is constructed of what might be considered a conventional size which is the same as filler necks or the like on large bottles, cans, and the like currently being filled and sold by beverage bottlers. In one example of this invention, the fitting 37 was constructed so that it could be readily handled utilizing existing cleaning and bottling equipment which normally handles bottles or containers having a so-called 42 millimeter crown.

The container construction 20 has the previously mentioned spigot device 26 carried by the outwardly convex wall portion 33 thereof and the spigot device 26 of FIG. 5 has a bayonet type fitting, which is well known in the art, and is particularly adapted to be received in a bayonet type opening 59 provided in the central part of the outwardly convex end portion 33. The spigot device 26 of this example has suitable connecter means, indicated at 66 in FIG. 1 for receiving the fitting 25; and, the bayonet type spigot device may also be provided with a visual indicator or sight glass 67 of known construction which changes appearance once the liquid drops beneath the level of such sight glass indicating that the container construction 20 is approximately one-half full.

The container construction 20 of FIG. 6 has as a part of its spigot device 26 the usual anti-foam tube 68 which has an inlet 69; and, the operation of the spigot device 26 is well known and thus will not be described in detail.

The container construction 20 is of the type wherein the spigot assembly 26 may remain attached whereby washing and sanitizing of the container construction 20, including the spigot device 26, is achieved utilizing conventional washing equipment through the conventionally sized fitting 37. The chamber 31 may then be filled with a carbonated beverage and sealed with a closure similar to closure 60 again using conventional equipment in wide use throughout the bottling industry whereupon the filled container construction is ready for sale and use by a consumer. The consumer merely attaches the fitting 25 in position thereby attaching the container construction 20 to the pressurized bottle 21 to supply carbon dioxide under regulated pressure to the container construction 20.

Figure 7:
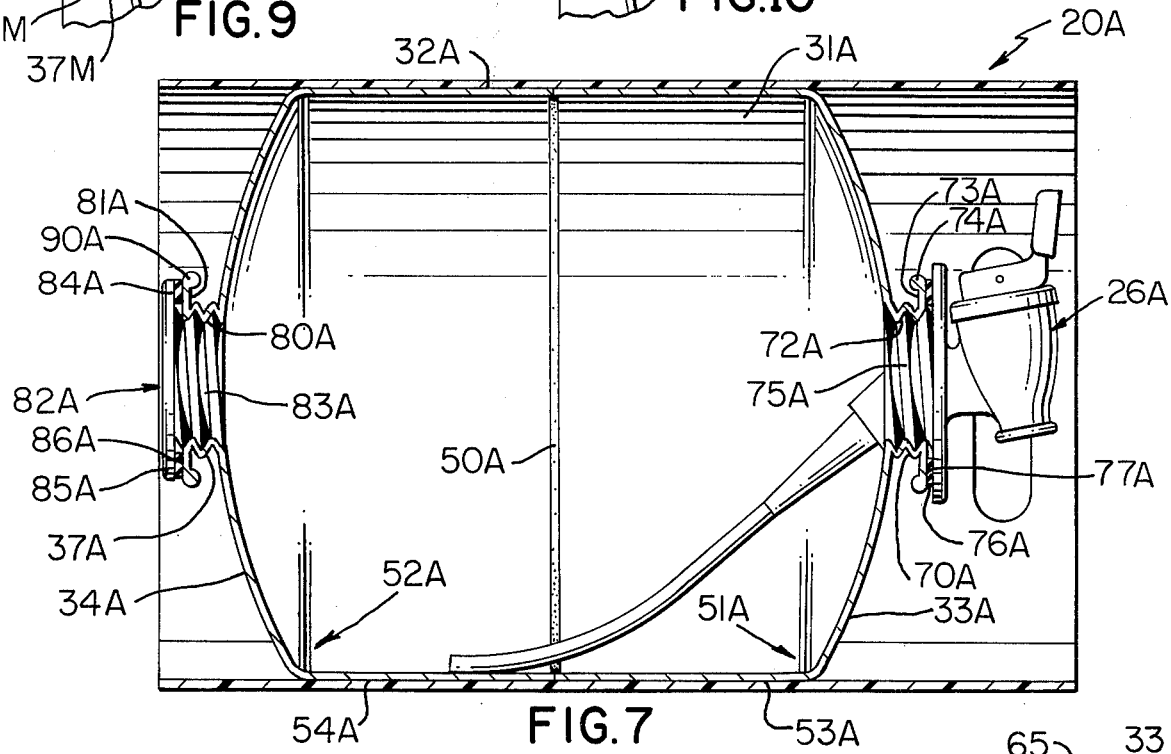
FIG. 7 is a view similar to FIG. 6 and illustrating a modification of the container of FIG. 6.

Another exemplary embodiment of the container construction of this invention is illustrated in FIG. 7 of the drawings. The container construction of FIG. 7 is very similar to the container construction 20; therefore, such container construction will be designated by the reference numeral 20A and representative parts of such container construction which are similar to corresponding parts of the container construction 20 will be designated in the drawing by the same reference numeral as in the container construction 20 (whether or not such parts are mentioned in the specification) followed by the associated letter designation A and not described again in detail. Only those components parts of the container construction 20A which are different from corresponding parts of the container construction 20 will be designated by a new reference numeral also followed by the associated letter designation and described in detail.

The main difference between the container construction 20 and the container construction 20A is in the manner in which the spigot device 26 the closable filler device 37A are provided at opposite ends of the container construction 20A. The container construction 20A, instead of having a bayonet opening for receiving the spigot device, has its outwardly convex housing portion 33A provided with an integral tubular portion 70A which is provided with a first set of internal threads 72A which are defined by thread-like convolutions in the entire wall thickness of the tubular portion 70A. The tubular portion 70A also has an outwardly extending annular flange 73A which terminates in a bead 74A.

The spigot device 26A has a cooperating set of external threads 75A which are threadedly received in the threads 72A and the spigot device 26A has a annular sealing gasket 76A which engages the outside substantially planar annular surface 77A of flange 73A. The tubular portion 70A with its flange 73A, outwardly convex portion 33A, and part 53A of cylindrical portion 32A are provided as a single-piece construction.

The fitting 37A provided at the opposite end of the container construction 20A for filling and cleaning purposes has integral threads therein in the form of internal threads 80A defined by thread-like convolutions in the entire wall thickness of the tubular filler device 37A; and, the filler device 37A also has a radially outwardly extending flange 81A provided with an annular planar surface defining its outside surface. A threaded closure cap or plug 82A is provided and such closure plug has external threads 83A which are threadedly received within the internal threads 81A to provide a seal for chamber 31A; and, the plug 82A may have a gasket 84A provided between a lip portion 85A of the plug 82A and the outside surface 86A of the flange 81A.

The flange 81A also has an annular bead 90A whereby instead of using plug 82A a closure similar to the closure 60 may be mechanically crimped in position against the flange 81A and in particular around the bead 90A thereof.

It will also be seen that the closeable filler device 37A, outwardly convex portion 34A, and portion 54A of the cylindrical portion 32A are provided as a single-piece construction designated 52A.

Figure 9:
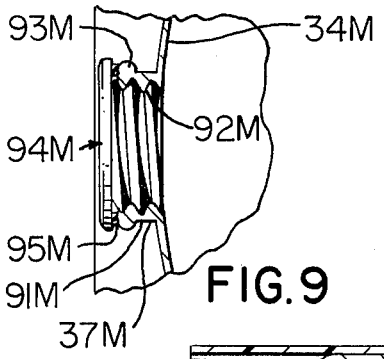
FIG. 9 is a fragmentary view with parts in cross section and parts in elevation illustrating a modified filler device which may be used in either of the container constructions of FIGS. 6 or 7.

The container construction 20 or 20A may have a modified closeable filler device as shown in FIG. 9 and such filler will be designated by the reference numeral 37M. The filler device 37M has a smooth tubular outside surface 91M and is provided with only internal threads 92M and an outer bead 93M with the bead 93M being particularly adapted to receive a closure similar to the closure 60 therearound, if desired. The internal threads 92M are particularly adapted to receive an externally threaded closure plug 94M made of an elastomeric material and thus having sealing means 95M provided as an integral annular portion thereof. The filler device 37M is also preferably provided as an integral part of its associated outwardly convex wall portion 34M.

Figure 10:
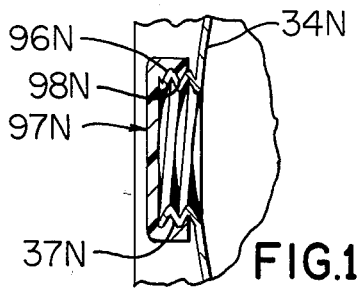
FIG. 10 is a fragmentary cross-sectional view illustrating still another modification of a filler device which may be used in either of the container constructions of FIGS. 6 or 7.

Another modification of a filler device is illustrated in FIG. 10 and designated generally by the reference numeral 37N. The filler 37N is also provided as an integral part of its outwardly convex wall portion 34N and may have external threads 996N which may be defined as full wall thickness convolutions in the filler 37N. The threads 96N are particularly adapted to receive an elastomeric closure cap 97N having internal threads 98N which are threadedly received around the threads 96N. The filler 37N is also preferably provided as a unitary integral part of its associated outwardly convex portion 34N.

The fillers 37A, 37M, 37N, or similar fittings may be provided as an integral part of the container 20 in lieu of the fitting 37 illustrated. Likewise fillers 37, 37M, and 37N may be provided on container 20A in lieu of filler 37A. Similarly instead of providing container 20 with the bayonet-type opening 59 therein, it may be provided with a threaded tubular portion similar to the portion 70A for receiving a spigot device similar to the spigot device 26A.

It will also be appreciated that instead of defining the tubular portions 37, 37A, 37M, and 37N, and 70A as integral single-piece parts within their associated outwardly convex walls these tubular portions may be made as separate components and fixed to their convex walls in accordance with any technique known in the art.

Figure 11:
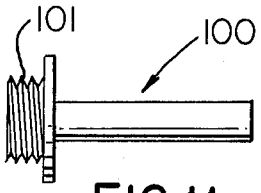
FIG. 11 is a perspective view of a pouring spout which may be used with the container construction of FIG. 7.

The dispensing container 20A may be provided with a suitable threaded spout as illustrated in FIG. 11 and such spout is designated by the reference numeral 100. The spout 100 may be used to pour the contents from within the associated container construction such as container construction 20A prior to connecting the bottle of carbon dioxide 21 thereto. The dispensing spout 100 may be provided with a threaded portion 101 particularly adapted to be threadedly received in either the threaded tubular portion 70A or the threaded filler device 37A whereby the contents of container 20A could be poured from either end thereof. In addition, it will be appreciated that the pouring spout 100 may be provided with a bayonet-type fitting of known construction so that it could be received in the bayonet opening 59 of the container construction 20 or the unmodified pouring spout 100 could be utilized in a modified container construction 20 which utilizes a threaded filler device instead of the unthreaded type 37.

The protective sleeve 40 for the housing may be provided with elongated openings 101 therein as shown in FIG. 1 and such openings may be used in defining carrying handles for the container construction 20.

While present exemplary embodiments of this invention, and methods of practicing the same, have been illustrated and described, it will be recognized that this invention may be otherwise variously embodied and practiced within the scope of the following claims.

What is claimed is:

1. A dispensing container construction for a liquid under gaseous pressure comprising, a housing defining a product chamber for said liquid, said housing comprising a cylindrical central portion and a pair of outwardly convex end portions, a spigot device carried by one of said end portions for dispensing said liquid from within said chamber, a closeable filler device for said chamber provided in the other of said end portions, a protective sleeve disposed around said housing and said devices, said sleeve having opposed end edges each arranged outwardly of its associated device and each for supporting said container construction, said end edges defining the axial length of said sleeve therebetween and said sleeve having a uniform single thickness throughout its entire axial length, said sleeve having an identical peripheral outline at each cross section along said length, said sleeve being a tubular single piece sleeve having integral anti-roll means, said anti-roll means being a bottom trough provided as a portion of said single piece sleeve and extending the full length thereof, said trough having a bottom which has a substantially planar bottom supporting surface said trough serving to collect any liquid dripping from said spigot device, said cylindrical central portion of said housing having its entire lower periphery disposed within said trough adjacent said bottom, and means holding said sleeve and housing together.

2. A container construction as set forth in claim 1 wherein said housing is made of a metallic material and said protective sleeve is made of a non-metallic material.

3. A container construction as set forth in claim 2 in which, said housing is made of an aluminous material, said protective sleeve is made of a plastic material, and said means holding said sleeve and housing together is a friction fit therebetween.

4. A container construction as set forth in claim 2 in which said one end portion has a first set of threads therein and said spigot device is threadedly connected to said first set of threads.

5. A container construction as set forth in claim 2 in which said one end portion has a bayonet-type opening therein and said spigot device has a bayonet-type fitting received within said bayonet-type opening.

6. The container construction as set forth in claim 2 in which said filler device in said other of said ends comprises a tubular fitting and further comprising a closure for sealing said fitting and chamber.

7. A container construction as set forth in claim 6 in which said fitting receives therearound, said closure having weakening means therein, said closure having a pull-tab which upon pulling thereof severs said weakening means and splits said closure to facilitate its removal.

8. A container construction as set forth in claim 6 in which said fitting has integral threads and said closure has cooperating threads, said integral threads of said fitting being particularly adapted to threadedly receive the cooperating threads on said closure.

9. A container construction as set forth in claim 8 in which said integral threads of said fitting are internal threads and said cooperating threads of said closure cap are external threads.

10. A container construction as set forth in claim 8 in which said integral threads of said fitting are external threads and said cooperating threads of said closure cap are internal threads.

11. A dispensing container construction for a carbonated beverage under carbon dioxide pressure comprising, a housing defining a product chamber for said beverage, said housing comprising a cylindrical central portion and a pair of outwardly convex end portions, a spigot device carried by one of said end portions for dispensing said beverage from within said chamber, a closeable filler device for said chamber provided in the other of said end portions, said filler device being sized to receive commercial cleaning and bottling equipment, a protective sleeve disposed around said housing and said devices, said sleeve having opposed end edges each arranged outwardly of its associated device and each for supporting said container construction, said end edges defining the axial length of said sleeve therebetween and said sleeve having a uniform single thickness throughout its entire axial length, said sleeve having an identical peripheral outline at each cross section along said length, said sleeve being a tubular single piece sleeve having integral anit-roll means, said anit-roll means being in the form of a bottom trough provided as a portion of said single piece sleeve and extending the full length thereof, said trough having a bottom which has a substantially planar bottom supporting surface said trough serving to collect any liquid dripping from said spigot device, said cylindrical central portion of said housing having its entire lower periphery disposed within said trough adjacent said bottom, and means holding said sleeve and housing together.

12. A container construction as set forth in claim 11 in which said cylindrical central portion is comprised of two right circular cylindrical half portions, one of said outwardly convex end portions being fixed to one of said cylindrical half portions and the other of said outwardly convex end portions being fixed to the other of said cylindrical half portions.

13. A container construction as set forth in claim 11 in which said cylindrical central portion is comprised of two welded cylindrical half portions, one of said outwardly convex end portions being provided as an integral part of one of said cylindrical half portions and the other of said outwardly convex end portions being provided as an integral part of the other of said cylindrical half portions.

14. A container construction as set forth in claim 13 in which, said housing is made of an aluminous material, said protective sleeve is made of a plastic material, and said means holding said sleeve and housing together is a friction fit therebetween.

15. A container construction as set forth in claim 14 in which said one end portion has a first set of threads therein and said spigot device is threadedly connected to said first set of threads.

16. A container construction as set forth in claim 14 in which said one end portion has a bayonet-type opening therein and said spigot device has a bayonet-type fitting received within said bayonet-type opening.

17. The container construction as set forth in claim 14 in which said filler device in said other of said ends comprises a tubular fitting and further comprising a closure for sealing said fitting and chamber.

* * * * *